US005825330A

United States Patent [19]

Na et al.

[11] Patent Number: 5,825,330

[45] Date of Patent: Oct. 20, 1998

[54] RADIO ANTENNA

[75] Inventors: Bo-Gyu Na, Kyungki-do; Young-Bae Ji, Suwon, both of Rep. of Korea

[73] Assignee: Samsung Electronics Co., Ltd., Suwon, Rep. of Korea

[21] Appl. No.: 590,294

[22] Filed: Jan. 23, 1996

[30] Foreign Application Priority Data

Jan. 27, 1995 [KR] Rep. of Korea ..... 1995/1628

[51] Int. Cl.[6] ..... H01Q 1/24

[52] U.S. Cl. ..... 343/702; 343/895; 343/900

[58] Field of Search ..... 343/702, 895, 343/900, 901; H01Q 1/24

[56] References Cited

U.S. PATENT DOCUMENTS

| | | | |
|---|---|---|---|
| 4,121,218 | 10/1978 | Irwin et al. | 343/702 |
| 4,868,576 | 9/1989 | Johnson, Jr. | 343/702 |
| 5,204,687 | 4/1993 | Elliott et al. | 343/702 |
| 5,317,325 | 5/1994 | Bottomley | 343/702 |
| 5,343,213 | 8/1994 | Kottke et al. | 343/702 |
| 5,353,036 | 10/1994 | Baldry | 343/702 |
| 5,389,938 | 2/1995 | Harrison | 343/702 |
| 5,426,440 | 6/1995 | Shimada | 343/702 |
| 5,434,582 | 7/1995 | Koike et al. | 343/702 |
| 5,438,339 | 8/1995 | Itoh et al. | 343/702 |
| 5,446,469 | 8/1995 | Makino | 343/702 |
| 5,455,595 | 10/1995 | Yokoyama et al. | 343/702 |
| 5,467,096 | 11/1995 | Takamoro et al. | 343/702 |
| 5,469,177 | 11/1995 | Rush et al. | 343/701 |
| 5,479,178 | 12/1995 | Ha | 343/702 |
| 5,612,704 | 3/1997 | Cole | 343/702 |

FOREIGN PATENT DOCUMENTS

| | | | |
|---|---|---|---|
| 511577A2 | 4/1992 | European Pat. Off. | H01Q 1/24 |
| 644606A1 | 3/1994 | European Pat. Off. | H01Q 1/24 |

*Primary Examiner*—Hoanganh T. Le
*Attorney, Agent, or Firm*—Robert E. Bushnell, Esq.

[57] ABSTRACT

An antenna configuration includes a rod antenna and a helical antenna that are independently operable. The helical antenna is composed of a helical coil installed within an antenna housing mounted on a main body of a communication device. A feeding connector is electrically coupled to a bottom portion of the helical coil to thereby connect the helical antenna to a circuit of the communication device. The rod antenna is composed of a rod functioning as a conductive metal core wire. The rod is surrounded by the helical coil and the feeding connector and is extendable from and retractable into the main body of the communication device. When the rod is retracted into the main body, the helical coil operates as the exclusive radiating element and operation of the rod antenna is disabled. When the rod is extended from the main body, the rod electrically short-circuits and disables operation of the helical coil, and thereby operates as the exclusive radiating element.

26 Claims, 7 Drawing Sheets

$$* \begin{cases} a : 45.064 - j1.2539\,\Omega \\ b : 48.225 - j3.3574\,\Omega \\ c : 43.434 + j1.8809\,\Omega \end{cases}$$

$$* \begin{cases} a : 42.107 + j0.2656\,\Omega \\ b : 44.756 - j1.9004\,\Omega \\ c : 40.727 + j2.8418\,\Omega \end{cases}$$

RADIO ANTENNA

CROSS-REFERENCE TO RELATED APPLICATIONS

This application makes reference to, incorporates the same herein, and claims all benefits accruing under 35 U.S.C. §119 from an application for Radio Antenna earlier filed in the Korean Industrial Property Office on 27 Jan., 1995 and there assigned Ser. No. 1628/1995.

BACKGROUND OF THE INVENTION

The present invention relates to radio antennas, and more particularly to radio antennas having at least two or more independent radiating elements.

Generally, in a portable radio which uses only a rod antenna that is extendible from and retractable into a radio housing, when the rod antenna is retracted into the radio housing, metallic objects, such as a printed circuit board installed within the radio body, function as an obstacle to radio wave propagation. Therefore, in these cases the effective gain of the antenna is greatly reduced, as compared to when the rod antenna is extended from the radio housing. Furthermore, since a different antenna impedance is generated when the rod antenna is extended, versus when retracted, it is difficult to achieve antenna impedance matches in both of the above cases. Moreover, if the antenna impedance generated when the rod antenna is extended is regarded as an optimal state, reception sensitivity and radiating power efficiency when the rod antenna is retracted can become quite poor, and the distance over which the portable radio can effectively communicate is reduced.

Therefore, due to the problems stated above, many manufacturers of antennas and portable radios use various methods of construction. The first method is to construct the rod antenna in an extended, non-retractable state; this typically makes the portable radio more difficult to move. The second method is to modify antenna construction to improve its ability to extend and retract, although antenna efficiency is reduced by some degree. The third method is to operate a second antenna (i.e., a helical antenna) when the rod antenna is retracted. Of these methods, manufacturers often use the third method which utilizes two different antennas.

With the third method, the second (i.e., helical) antenna is disposed on a main body of the radio and typically operates when the rod antenna is retracted. In order to render the radio more easily movable, the space occupied by the helical antenna should be minimized, and the radio should be moved when the rod antenna is retracted. In this configuration, the gain of the helical antenna is degraded to some degree, as compared with the rod antenna. However, the helical antenna is generally used because of its convenient, small size.

Conventional portable radio apparatuses having both a helical antenna and a rod antenna are disclosed in U.S. Pat. Nos. 4,121,218, 4,868,576, and 5,204,687.

The helical antenna disclosed in U.S. Pat. No. 4,868,576 is always connected to a feeding connector and operates, regardless of whether or not the rod antenna is extended. The rod antenna and the helical antenna are capacitively coupled when the rod antenna extended so that the rod antenna and the helical antenna are operated as a single antenna. In order to capacitively connect the helical antenna to the rod antenna, however, the length of the rod antenna must be rather long. Also, since the center portion of the rod antenna is composed of a conductive helical winding, the diameter of the rod antenna is unaesthetically large. Furthermore, a problem arises in that the rod antenna and the helical antenna can not be independently operated.

According to the conventional device disclosed in U.S. Pat. No. 5,204,687, when the rod antenna is extended, only the rod antenna is operated; whereas when the rod antenna is retracted, only the helical antenna is operated. In order to independently operate the two antennas, the helical antenna is disposed on a top portion of the rod antenna and the two antennas are electrically separated by a molded material having an insulating characteristic. Thus, when the rod antenna is extended, only the rod antenna operates by connecting to a feeding connector disposed at a bottom portion of the helical antenna. On the other hand, when the rod antenna is retracted, only the helical antenna operates via a connection to the feeding connector.

With the conventional device disclosed in U.S. Pat. No. 5,204,687, however, since the helical antenna is disposed on a top portion of the rod antenna, there arises a problem in that the top portion of the rod antenna is required to be quite large in size. Accordingly, the device becomes rather top heavy when the rod antenna is extended. Furthermore, there is little aesthetic appeal in the construction of the two antennas.

Another conventional arrangement in which a portable radio device includes both a rod antenna and a helical antenna is disclosed in Korean Patent Application No. 93-8786 (U.S. patent application Ser. No. 08/176,455, now issued as U.S. Pat. No. 5,479,178). Korean Patent Application No. 93-8786 discloses a configuration wherein the rod antenna is insulated from the helical antenna when the rod antenna is retracted, to thereby enable operation of the helical antenna. On the other hand, when the rod antenna is extended, the rod antenna and the helical antenna are commonly connected to a feeding connector.

Accordingly, the conventional device disclosed in Korean Patent Application No. 93-8786 has a drawback in that it is difficult to independently operate only the rod antenna, since the helical antenna is connected to the feeding connector even when the rod antenna is extended. As mentioned above, in cases where the rod and helical antennas are not independently operated, a change in the length of any one antenna affects the other antenna. Therefore, it is difficult to match impedances without an electrical switching circuit. Accordingly, the design of the portable radio and its antenna becomes more complicated.

SUMMARY OF THE INVENTION

Accordingly, it is an object of the present invention to provide an improved radio antenna apparatus.

It is another object to provide a radio antenna appatatus having both a rod antenna and a helical antenna as radiating elements.

It is still another object to provide a radio antenna apparatus having a rod antenna and a helical antenna that can be independently operated.

It is yet another object to provide a radio antenna apparatus having a rod antenna and a helical antenna in which the helical antenna does not operate when the rod antenna is extended.

It is still yet another object to provide a radio antenna apparatus having a rod antenna and a helical antenna in which only the helical antenna operates when the rod antenna is retracted.

It is a further object to provide a radio antenna apparatus having both a rod antenna and a helical antenna, in which a change in the impedance matching point for one antenna according frequency variations, does not affect the other antenna.

These and other objects can be achieved in accordance with the principles of the present invention with an antenna configuration including a rod antenna and a helical antenna that are independently operable. The helical antenna is composed of a helical coil installed within an antenna housing mounted on a main body of a communication device. A feeding connector is electrically coupled to a bottom portion of the helical coil to thereby connect the helical antenna to a circuit of the communication device. The rod antenna is composed of a rod functioning as a conductive metal core wire. The rod is surrounded by the helical coil and the feeding connector and is extendable from and retractable into the main body of the communication device. When the rod is retracted into the main body, the helical coil operates as the exclusive radiating element and operation of the rod antenna is disabled. When the rod is extended from the main body, the rod electrically short-circuits and disables operation of the helical coil, and thereby operates as the exclusive radiating element.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein:

FIG. 1A shows the portable radio antenna in an extended position, and FIG. 1B shows the portable radio antenna in a retracted position;

FIG. 2A is a cross-sectional view showing a final coupling state when the rod antenna is extended, and FIG. 2B is a cross-sectional view showing various components of the radio antenna in a separated state with an antenna housing removed;

FIG. 3A is a schematic view showing the electrical coupling state when the rod antenna is retracted, FIG. 3B is a schematic view showing the electrical coupling state when the rod antenna is extended, and FIG. 3C is another schematic view showing the electrical coupling state when the rod antenna is extended;

DETAILED DESCRIPTION OF THE PREFERRED EMBODIMENT

Figure 1A:
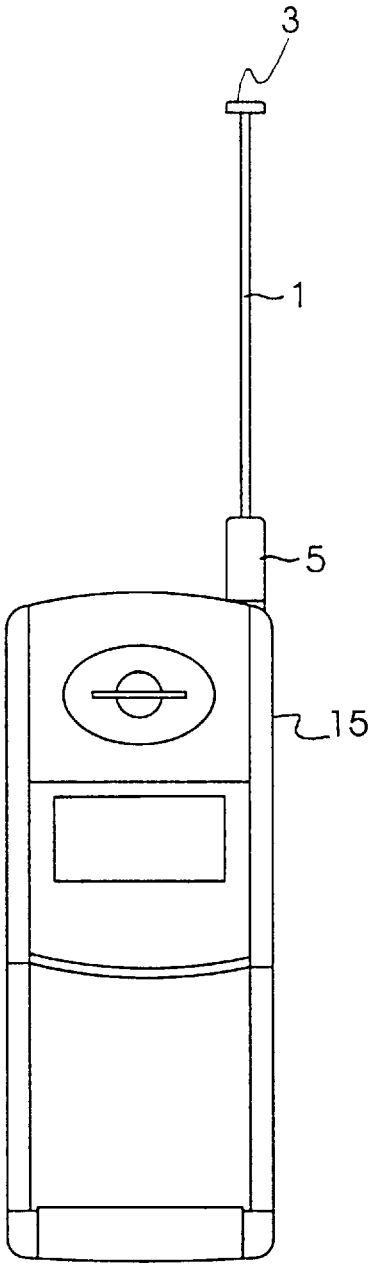
FIGS. 1A and 1B are front views of a portable radio antenna constructed according to the principles of the present invention.
Figure 1B:
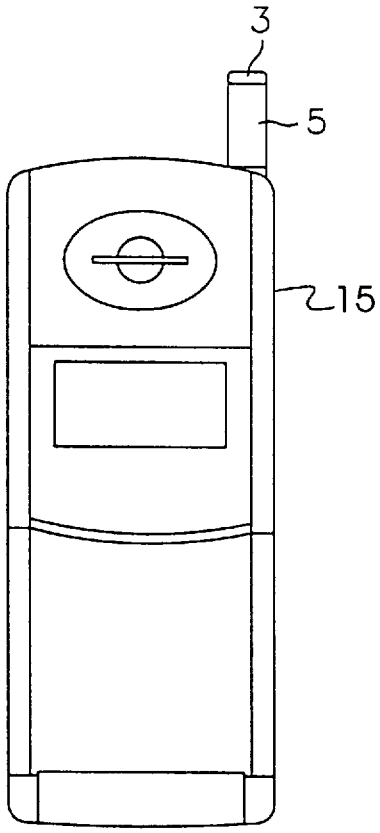

Turning now to the drawings and referring to FIGS. 1A and 1B, front views of a portable radio antenna constructed according to the principles of the present invention are shown. In FIG. 1A, a rod 1 of a rod antenna has a head 3 and is extended from an antenna housing 5 mounted on a top portion of a main body 15 of a communication device. In FIG. 1B, rod 1 of the rod antenna is retracted into main body 15 of the communication device through antenna housing 5, and head 3 is fixedly attached to antenna housing 5.

Figure 2A:
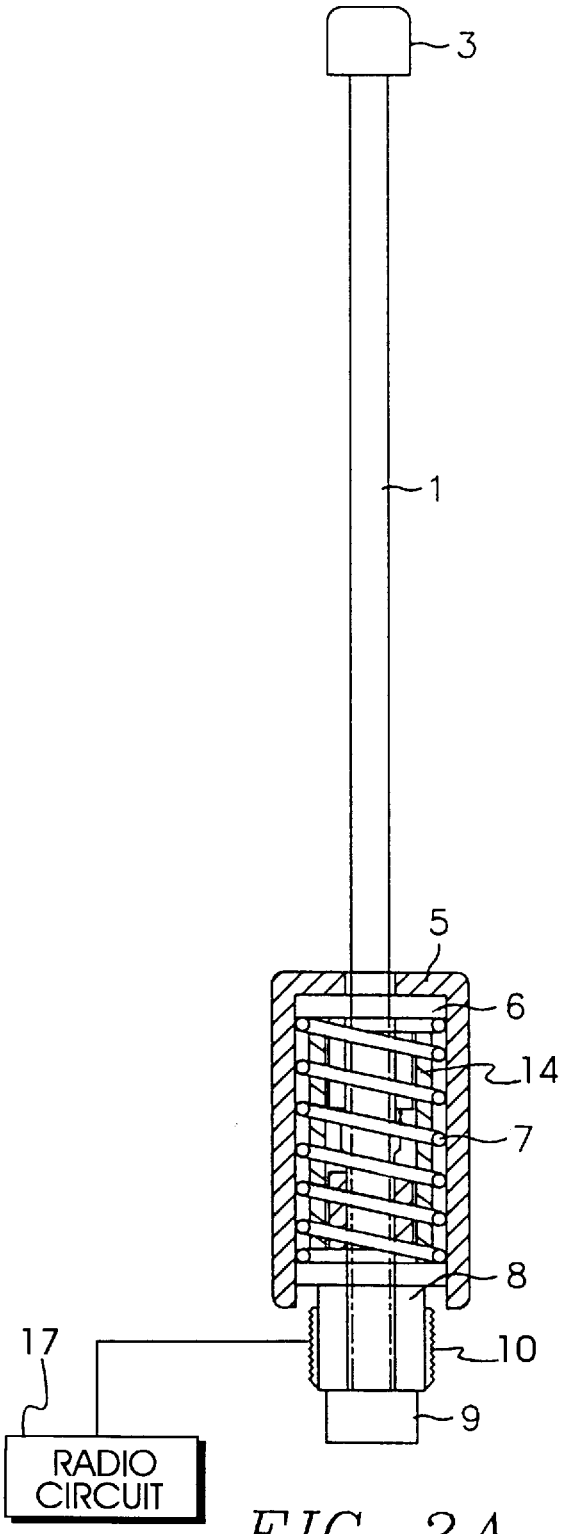
FIGS. 2A and 2B are cross-sectional views of the portable radio antenna constructed according to the principles of the present invention.
Figure 2B:
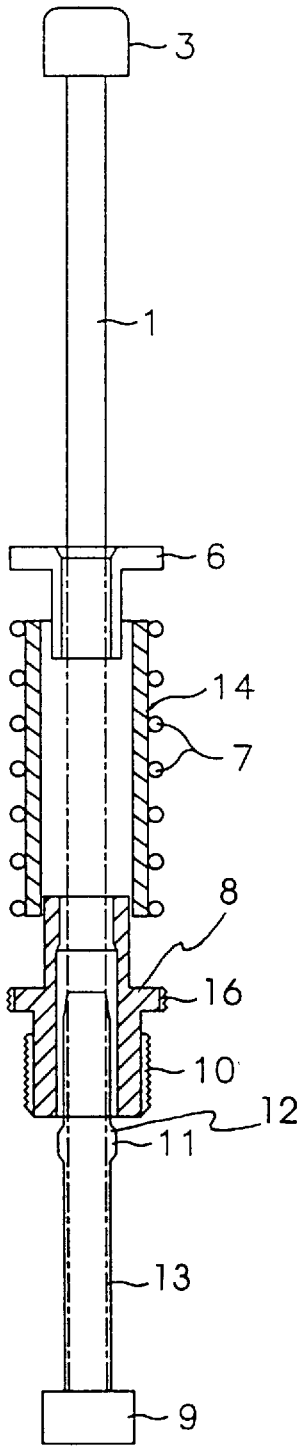

FIGS. 2A and 2B are cross-sectional views of the portable radio antenna constructed according to the principles of the present invention. FIG. 2A is a cross-sectional view showing a final coupling state when the rod antenna is extended, and FIG. 2B is a cross-sectional view showing the various components of the portable radio antenna in a separated state with antenna housing 5 removed.

Referring to FIGS. 2A and 2B, the portable radio antenna of the present invention includes: a rod antenna, a helical antenna, antenna housing 5, an insulating sleeve 14, a feeding connector 8 and a metallic cylindrical tube 6. Antenna housing 5 may be constructed from an electrically insulating material having a low dielectric permittivity relative to air (e.g., $\in_r=1$). The rod antenna is comprised of rod 1 constructed as an electrically conductive metal core wire, head 3 positioned at a topmost portion of rod 1, a coating 13 disposed on a bottom portion of rod 1, a contact member 11 extending outwardly from rod 1 with an upper portion 12 for providing an electrical connection to rod 1, and an end portion 9 postioned at a bottommost portion of rod 1 to prevent rod 1 from being pulled from main body 15 (not shown in FIGS. 2A and 2B). The helical antenna is comprised of an electrically conductive helical coil 7 installed within antenna housing 5. Helical coil 7 is provided with support by being wound about an outer circumference of insulating sleeve 14 that is positioned between feeding connector 8 and cylindrical tube 6. A top portion of helical coil 7 is electrically coupled to cylindrical tube 6, and a bottom portion of helical coil 7 is electrically coupled to feeding connector 8. Feeding connector 8 acts as an electrical conductor and has threaded fastening members 10 and 16 on lower and upper portions, respectively. Fastening member 16 on the upper portion of feeding connector 8 connects to antenna housing 5, and fastening member 10 on the lower portion of feeding connector 8 connects to main body 15 of the communication device. Feeding connector 8 is electrically coupled to a radio circuit board 17 installed within main body 15.

Accordingly, referring to FIGS. 1A through 2B, it is intuitive that rod 1 extends and retracts through cylindrical tube 6, helical coil 7, insulating sleeve 14 and feeding connector 8.

Figure 3C:
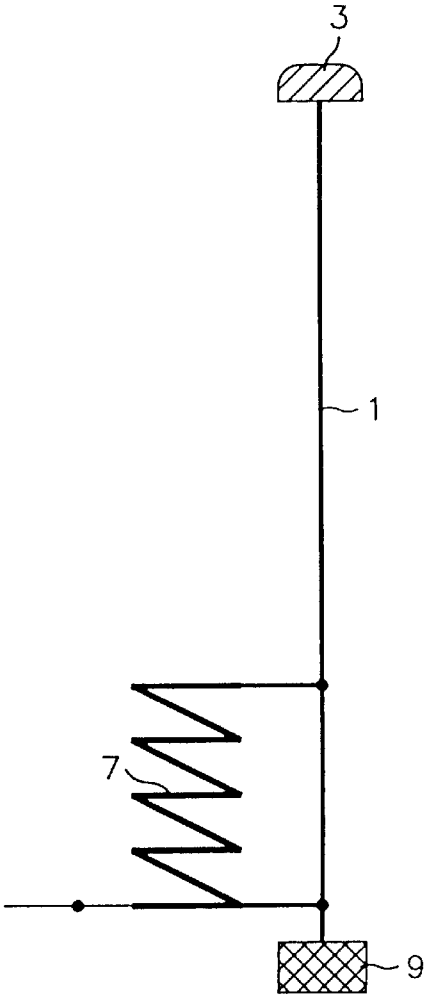
FIGS. 3A to 3C are schematic views illustrating electrical coupling states of the portable radio antenna constructed according to the principles of the present invention.
Figure 3B:
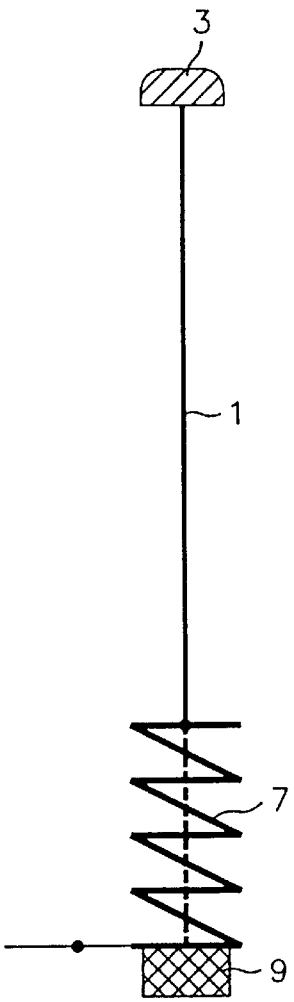
Figure 3A:
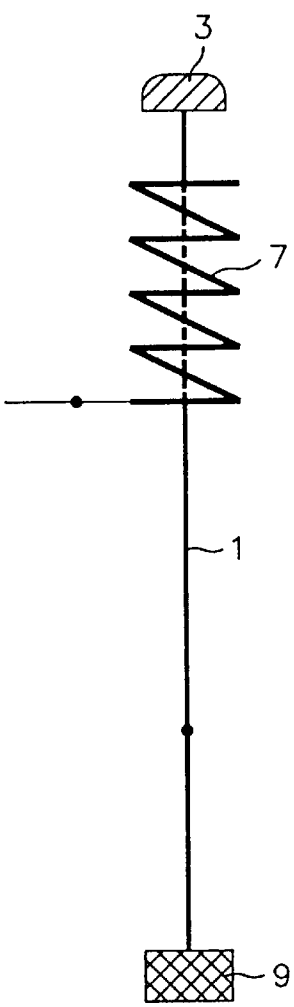

FIGS. 3A to 3C are schematic views illustrating electrical coupling states of the portable radio antenna constructed according to the principles of the present invention. FIG. 3A is a schematic view showing the electrical coupling state when the rod antenna is retracted, FIG. 3B is a schematic view showing the electrical coupling state when the rod antenna is extended, and FIG. 3C is another schematic view showing the electrical coupling state when the rod antenna is extended.

The portable radio antenna constructed according to the principles of the present invention will now be described in detail with reference to FIGS. 2A through 3C.

First, when the rod antenna is extended, upper portion 12 of contact member 11 is electrically coupled to an interior portion of cylindrical tube 6, and end portion 9 of the rod antenna is electrically coupled to a bottommost portion of feeding connector 8. Accordingly, rod 1 is electrically coupled to the bottom portion of helical coil 7 through the feeding connector 8, and is electrically coupled to the top portion of helical coil 7 through cylindrical tube 6. Therefore, when the rod antenna is extended, the electrical coupling state is as shown in FIG. 3C.

As shown in FIG. 3C, helical coil 7 of the helical antenna is short-circuited and rod 1 of the rod antenna operates exclusively when the rod antenna is extended.

In this state, even if the length of helical coil 7 is altered, the impedance of feeding connector 8 does not appreciably change. Accordingly, the function of helical coil 7 as a radiating element is only slight, as compared to rod 1.

As indicated above, the present invention provides feeding connector 8 to serve as a feeding point for the rod antenna and the helical antenna. According to the principles of the present invention, it is possible to optimally reduce operating variations of the rod antenna attributable to variations in the length of helical coil 7.

When the rod antenna is retracted, head 3 engages the top portion of antenna housing 5 and the top portion of rod 1 is surrounded by insulating sleeve 14 so that rod 1 is electrically insulated from helical coil 7. Accordingly, as shown in FIG. 3A, when the rod antenna is retracted, only helical coil 7 which is electrically coupled to feeding connector 8 operates as a radiating element. In this state, since the rod antenna is electrically insulated from the helical antenna, changes in the electrical length of the rod antenna have little effect on the operating characteristics of helical coil 7 which serves as the radiating element.

Figure 4:
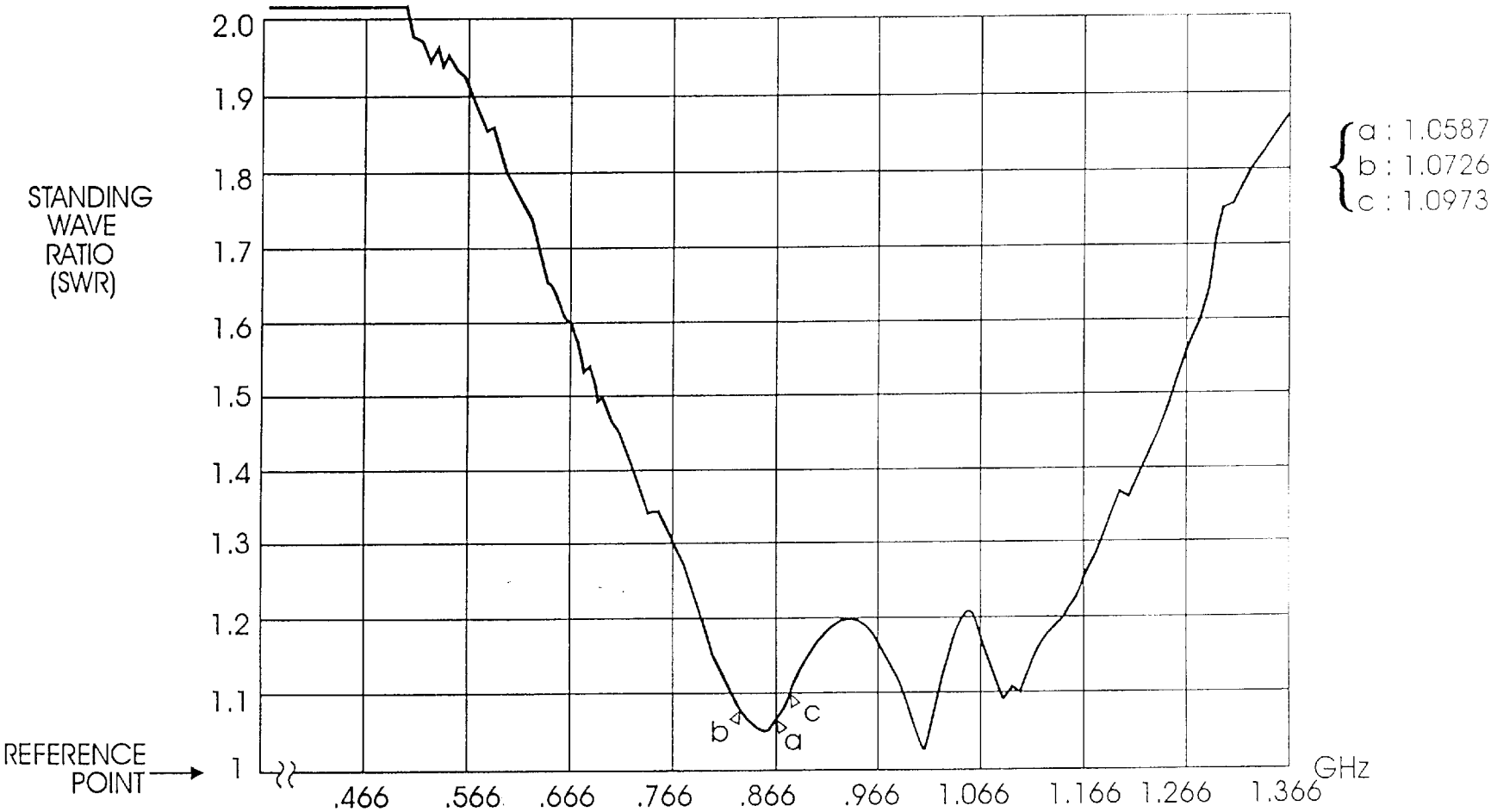
FIG. 4 is a graph illustrating Standing Wave Ratios versus frequency in accordance with the present invention when the rod antenna is extended.

FIG. 4 is a graph illustrating Standing Wave Ratios versus frequency in accordance with the present invention when the rod antenna is extended. Referring to FIG. 4, the rod antenna constructed according to the principles of the present invention has a Standing Wave Ratio of 1.0587, as indicated by point a, when the operating frequency is 0.8661 GHz. Similarly, when the operating frequency is 0.8640 GHz, the Standing Wave Ratio is 1.0726, as indicated by point b, and when the operating frequency is 0.86805 GHz, the Standing Wave Ratio is 1.0973, as indicated by point c. Note that the area in FIG. 4 representing those frequencies about operating frequency 0.8660 GHz is not necessarily shown to scale, and has been expanded for purposes of illustration.

Figure 5:
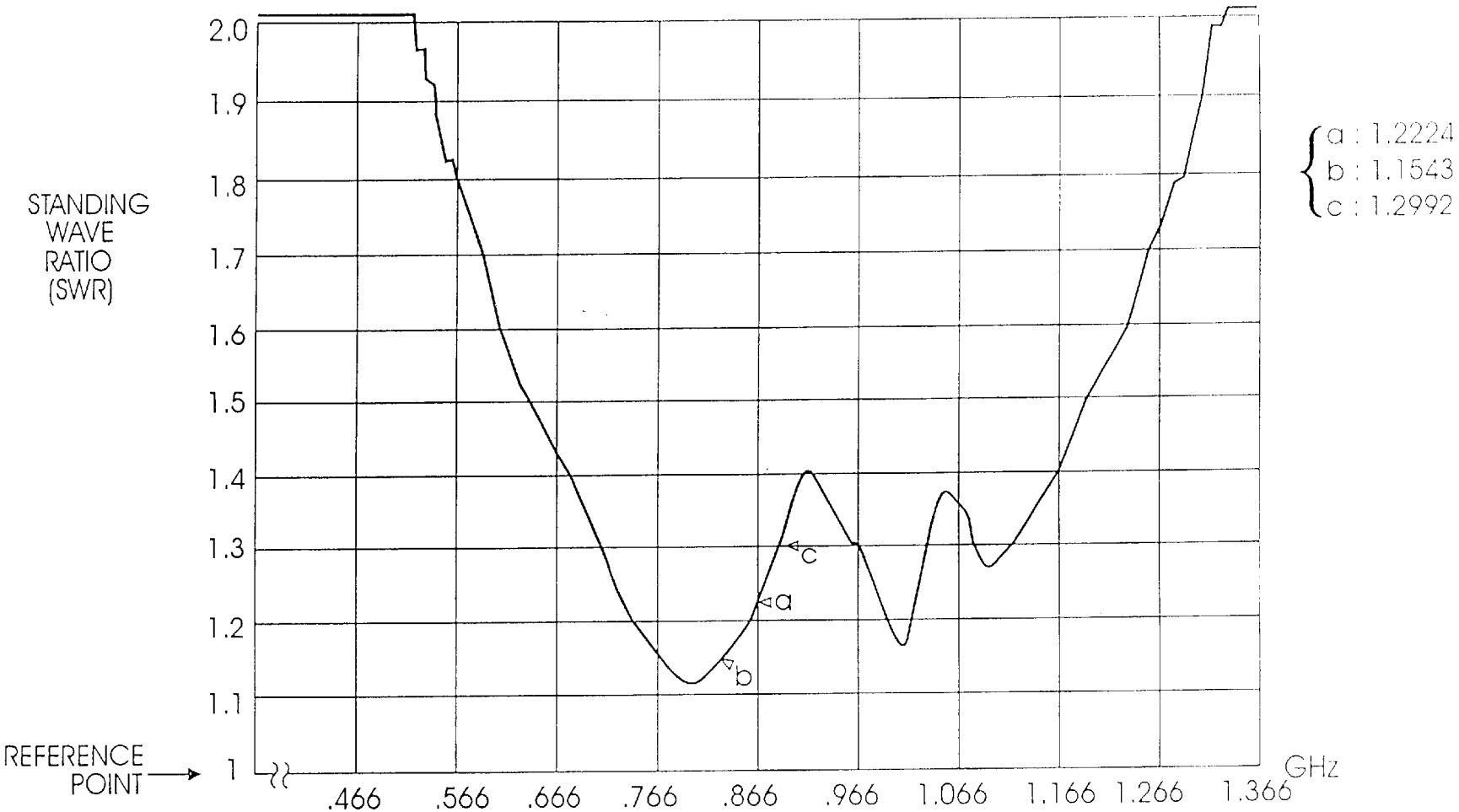
FIG. 5 is a graph illustrating Standing Wave Ratios versus frequency in accordance with the present invention when the rod antenna is retracted.

FIG. 5 is a graph illustrating Standing Wave Ratios versus frequency in accordance with the present invention when the rod antenna is retracted. Referring to FIG. 5, the helical antenna constructed according to the principles of the present invention has a Standing Wave Ratio of 1.2224, as indicated by point a, when the operating frequency is 0.8661 GHz. Similarly, when the operating frequency is 0.8640 GHz, the Standing Wave Ratio is 1.1543, as indicated by point b, and when the operating frequency is 0.86805 GHz, the Standing Wave Ratio is 1.2992, as indicated by point c. Note that the area in FIG. 5 representing those frequencies about operating frequency 0.8660 GHz is not necessarily shown to scale, and has been expanded for purposes of illustration.

Accordingly, it can be seen through FIGS. 4 and 5 that the antenna configuration of the present invention provides increased radiating efficiency as compared to a conventional radio antenna.

Figure 6:
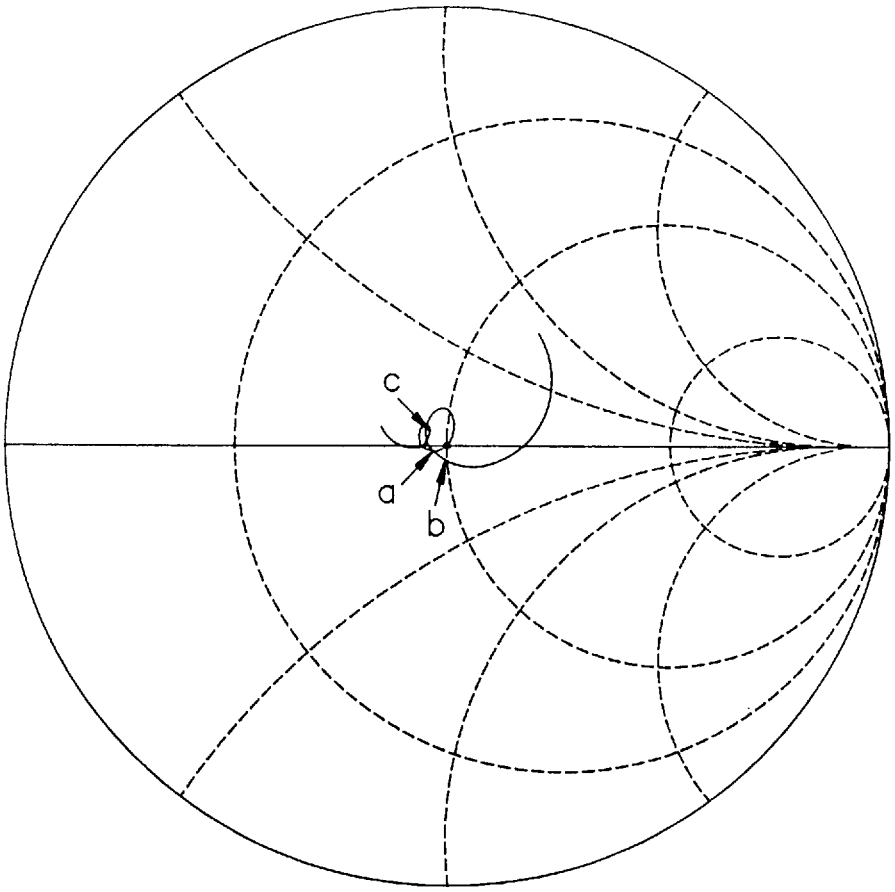
FIG. 6 is a Smith Chart illustrating rod antenna impedance in accordance with the present invention when the rod antenna is extended.

FIG. 6 is a Smith Chart illustrating rod antenna impedance in accordance with the present invention when the rod antenna is extended. Referring to FIG. 6, when the operating frequency is 0.8661 GHz, the rod antenna impedance is 45.064−j1.2539 Ω, as indicated by point a. Similarly, when the operating frequency is 0.8640 GHz, the rod antenna impedance is 48.225−j3.3574 Ω, as indicated by point b, and when the operating frequency is 0.86805 GHz, the rod antenna impedance is 43.434+j1.8809 Ω, as indicated by point c.

Figure 7:
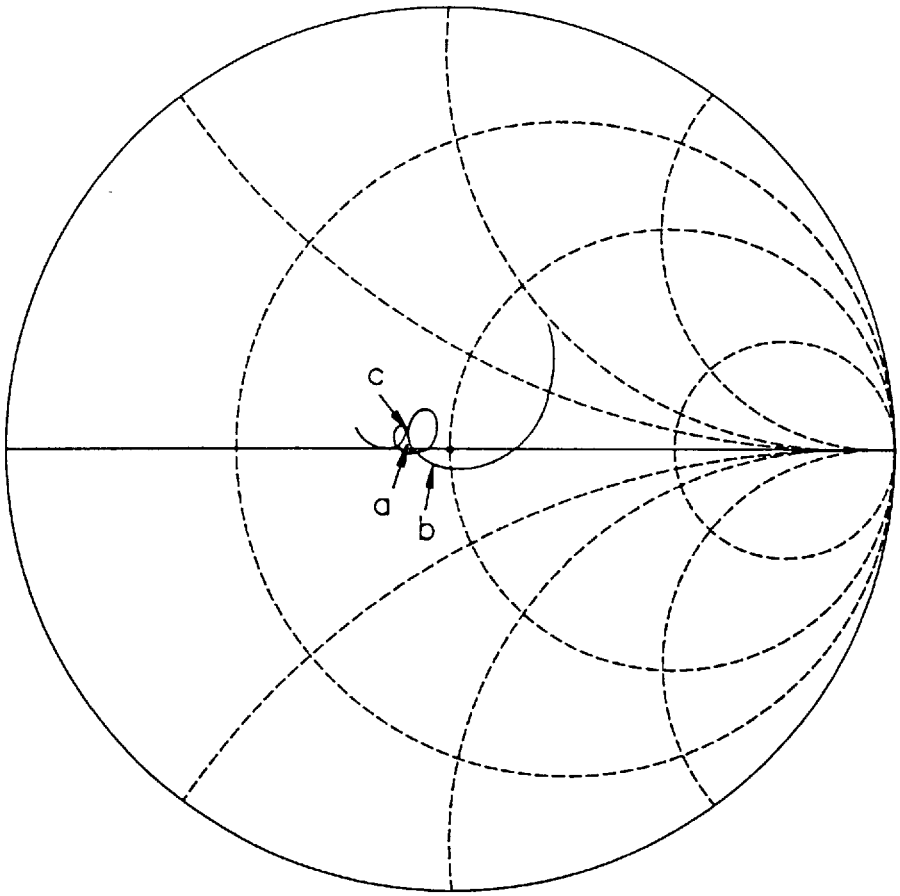
FIG. 7 is a Smith Chart illustrating helical antenna impedance in accordance with the present invention when the rod antenna is retracted.

FIG. 7 is a Smith Chart illustrating helical antenna impedance in accordance with the present invention when the rod antenna is retracted. Referring to FIG. 7, when the operating frequency is 0.8661 GHz, the helical antenna impedance is 42.107+j0.2656 Ω, as indicated by point a. Similarly, when the operating frequency is 0.8640 GHz, the helical antenna impedance is 44.756−j1.9004 Ω, as indicated by point b, and when the operating frequency is 0.86805 GHz, the helical antenna impedance is 40.727+j2.8418 Ω, as indicated by point c.

Accordingly, it can be seen through FIGS. 6 and 7 that the helical antenna impedance when the rod antenna is retracted is quite similar to the rod antenna impedance when the rod antenna is extended.

As described above, the present invention is employed to operate the rod antenna as the radiating element when the rod antenna is extended, and is also employed to operate the helical antenna as the radiating element when the rod antenna is retracted, without the requirement of a separate electrical insulating circuit. Furthermore, changes in the electrical length of the rod antenna have little effect on the helical antenna, and vice-versa. Therefore, if the impedance matching point of any one antenna is determined by its length, the impedance matching point of the other antenna is minimally adjusted. In this case, there is no need to revise an impedance matching circuit, and the two antennas can be independently operated.

Accordingly, the antenna configuration according to the present invention comprised of two antennas that are independently operable can be easily adapted to changes in an external design of the main body 15 of the communication device without reducing the function thereof. Furthermore, it is easy to adjust an impedance matching circuit, even when the operating frequency band is changed.

As mentioned above, the present invention provides an advantage in that the rod antenna and the helical antenna are independently operable based on whether the rod antenna is extended or retracted. Furthermore, the present invention increases overall radiating efficiency since one antenna has little affect on the operation of the other antenna.

Although only the preferred embodiment of the present invention is described herein, it will be intuitive to those skilled in the art that various modifications can be implemented without departing from the spirit and scope of the present invention. In particular, although a cylindrical tube is used in the disclosed embodiment of the present invention to electrically connect the helical coil to the contact member of the rod antenna, the helical coil may still be employed as the second antenna without use of the cylindrical tube. That is, it is possible to electrically connect the contact member of the rod antenna to the top portion of the helical coil when the rod antenna is extended by reducing the diameter of the top portion of the helical coil.

What is claimed is:

1. An antenna configuration for a communication device, said antenna configuration comprising:

helical antenna means comprising a helical coil having a first terminal portion separated by an intermediate length from a second terminal portion, said first terminal portion being installed within an antenna housing mounted on a main body of said communication device;

first connecting means electrically coupled to said first terminal portion of said helical coil for electrically coupling said helical coil to a circuit of said communication device; and rod antenna means comprising an electrically conducting rod surrounded by said helical coil and said first connecting means and being extendable from and retractable into said main body of said communication device, an uppermost length of said rod antenna means forming a distal end operating as an exclusive radiating element of said antenna configuration while said rod antenna means forms an electrical short circuit between said first terminal portion to said second terminal portion of said helical coil when said electrically conducting rod is extended from said main body of said communication device, and said distal end being physically surrounded by and electrically separated from said helical coil while said helical coil operates as said exclusive radiating element of said antenna configuration when said electrically conducting rod is retracted into said main body of said communication device and electrically insulated from said helical coil.

2. The antenna configuration as claimed in claim 1, further comprising:

said electrically conducting rod forming a continuous electrical path along said electrically conducting rod with a first electrical connection occurring between said electrically conducting rod and said first terminal portion and a second electrical connection occurring between said electrically conducting rod and said second terminal portion, and for interrupting said first electrical connection and said second electrical connection to accommodate said operation of said helical coil as said exclusive radiating element when said electrically conducting rod is retracted into said main body; and second connecting means being electrically coupled to said second terminal portion of said helical coil, for forming said second electrical connection by electrically coupling said electrically conducting rod to said helical coil when said electrically conducting rod is extended from said main body of said communication device.

3. The antenna configuration as claimed in claim 2, wherein said second connecting means is comprised of a metallic cylindrical tube surrounding said electrically conducting rod.

4. The antenna configuration as claimed in claim 3, wherein said rod antenna means comprises:

an end portion positioned at a bottommost end of said electrically conducting rod for engaging said first connecting means to electrically couple said electrically conducting rod to said first terminal portion of said helical coil when said electrically conducting rod is extended from said main body of said communication device; and a contact member extending outwardly from said electrically conducting rod to engage an interior portion of said metallic cylindrical tube and electrically couple said electrically conducting rod to said second terminal portion of said helical coil when said electrically conducting rod is extended from said main body of said communication device.

5. The antenna configuration as claimed in claim 2, further comprising an insulating sleeve positioned between said first connecting means and said second connecting means, said electrically conducting rod being surrounded by said insulating sleeve and said helical coil being wound about an outer circumference of said insulating sleeve.

6. The antenna configuration as claimed in claim 5, wherein said rod antenna means further comprises:

an end portion positioned at a bottommost end of said electrically conducting rod for engaging said first connecting means to electrically couple said electrically conducting rod to said first terminal portion of said helical coil when said electrically conducting rod is extended from said main body of said communication device; and a contact member extending outwardly from said electrically conducting rod to engage said second connecting means and electrically couple said electrically conducting rod to said second terminal portion of said helical coil when said electrically conducting rod is extended from said main body of said communication device.

7. The antenna configuration as claimed in claim 1, wherein said first connecting means comprises:

a first fastening member positioned on an upper portion of said first connecting means for providing a first junction between said first connecting means and said antenna housing; and a second fastening member positioned on an bottom portion of said first connecting means for providing a second junction between said first connecting means and said main body of said communication device.

8. An antenna configuration, comprising:

a helical antenna comprising a helical coil having a first terminal portion separated by an intermediate length from a second terminal portion, said first terminal portion being installed within an antenna housing mounted on a main body of a communication device;

first connecting means electrically coupled to said first terminal portion of said helical coil for electrically coupling said helical coil to a circuit of said communication device;

a rod antenna comprising a wire rod surrounded by said helical coil and said first connecting means and being extendable from and retractable into said main body of said communication device, said wire rod operating as an exclusive radiating element of said antenna configuration and electrically short circuiting and disabling operation of said helical coil when said wire rod is extended from said main body of said communication device by forming a continuous electrical path along said wire rod with a first electrical connection between said wire rod and said first terminal portion and a second electrical connection between said wire rod and said second terminal portion, and interrupting said first electrical connection and said second electrical connection to accommodate operation of said helical coil as said exclusive radiating element of said antenna configuration when said wire rod is retracted into said main body of said communication device and electrically insulated from said helical coil;

second connecting means electrically coupled to said second terminal portion of said helical coil for forming said second electrical connection by electrically coupling said wire rod to said helical coil when said wire rod is extended from said main body of said communication device;

an end portion positioned at a bottommost end of said electrically conducting rod engaging said first connecting means to electrically couple said electrically conducting rod to said first terminal portion of said helical coil when said electrically conducting rod is extended from said main body of said communication device; and a contact member extending outwardly from said electrically conducting rod to engage said second connecting means and electrically couple said electrically conducting rod to said second terminal portion of said helical coil when said electrically conducting rod is extended from said main body of said communication device.

9. A radio antenna for a communication device, said radio antenna comprising:

helical antenna means comprising a helical coil installed within an antenna housing mounted on a main body of said communication device;

first connecting means electrically coupled to a bottom portion of said helical coil for electrically coupling said helical coil to a circuit of said communication device;

second connecting means electrically coupled to a top portion of said helical coil;

rod antenna means comprising:

a wire rod surrounded by said helical coil and being extendable from and into said main body of said communication device;

an end portion positioned at a bottommost end of said wire rod for engaging said first connecting means to electrically couple said wire rod to said bottom portion of said helical coil when said wire rod is extended from said main body of said communication device; and a contact member extending outwardly from said wire rod to engage said second connecting means and electrically couple said wire rod to said top portion of said helical coil when said wire rod is extended from said main body of said communication device.

10. The radio antenna as claimed in claim 9, wherein said second connecting means is comprised of a metallic cylindrical tube surrounding said wire rod.

11. The radio antenna as claimed in claim 9, further comprising an insulating sleeve positioned between said first connecting means and said second connecting means, said wire rod being surrounded by said insulating sleeve and said helical coil being wound about an outer circumference of said insulating sleeve.

12. The radio antenna as claimed in claim 9, wherein said first connecting means comprises:

a first fastening member positioned on an upper portion of said first connecting means for providing a first connection between said first connecting means and said antenna housing; and a second fastening member positioned on an bottom portion of said first connecting means for providing a second connection between said first connecting means and said main body of said communication device.

13. The radio antenna as claimed in claim 12, further comprising an insulating sleeve positioned between said first connecting means and said second connecting means, said wire rod being surrounded by said insulating sleeve and said helical coil being wound about an outer circumference of said insulating sleeve.

14. The radio antenna as claimed in claim 9, further comprised of said helical coil operating as an exclusive radiating element of said radio antenna when said wire rod is retracted into said main body of said communication device, and said wire rod operating as said exclusive radiating element of said radio antenna when said wire rod is extended from said main body of said communication device.

15. An antenna configuration for a communication device, said antenna configuration comprising:

an antenna housing mounted on a main body of said communication device;

a helical coil having top and bottom terminals installed within said antenna housing;

a cylindrical tube electrically coupled to said top terminal of said helical coil;

a feeding connector having a first threaded fastener connected to said antenna housing and a second threaded fastener connected to said main body of said communication device, said feeding connector being electrically coupled to said bottom terminal of said helical coil for electrically coupling said helical coil to a circuit of said communication device;

a wire rod surrounded by said helical coil and being extendable from and retractable into said main body of said communication device;

a contact member extending outwardly from said wire rod to engage an interior portion of said cylindrical tube and electrically couple said wire rod to said top terminal of said helical coil when said wire rod is extended from said main body of said communication device; and means positioned at a bottommost end of said wire rod for engaging said feeding connector to electrically couple said wire rod to said bottom terminal of said helical coil when said wire rod is extended from said main body of said communication device.

16. The antenna configuration as claimed in claim 15, further comprising an insulating sleeve interposed between said cylindrical tube and said feeding connector, said wire rod being surrounded by said insulating sleeve and said helical coil being wound about an outer circumference of said insulating sleeve.

17. The antenna configuration as claimed in claim 16, further comprised of said helical coil operating as an exclusive radiating element of said antenna configuration when said wire rod is retracted into said main body of said communication device, and said wire rod operating as said exclusive radiating element of said antenna configuration when said wire rod is extended from said main body of said communication device.

18. The antenna configuration as claimed in claim 15, further comprised of said helical coil operating as an exclusive radiating element of said antenna configuration when said wire rod is retracted into said main body of said communication device, and said wire rod operating as said exclusive radiating element of said antenna configuration when said wire rod is extended from said main body of said communication device.

19. An antenna configuration, comprising:

a helical coil;

a first connector electrically coupled to a bottom portion of said helical coil;

a second connector electrically coupled to a top portion of said helical coil;

a wire rod positioned along center axes of said helical coil, said first connector and said second connector, respectively, and being moveable between an extended position and a retracted position;

a contact member extending outwardly from said wire rod to engage said second connector and electrically couple said wire rod to said top portion of said helical coil when said wire rod is in said extended position; and an end portion of said wire rod positioned at a bottommost end of said wire rod to engage said first connector and electrically couple said wire rod to said bottom portion of said helical coil when said wire rod is in said extended position.

20. The antenna configuration as claimed in claim 19, further comprising an insulating sleeve positioned between said first connector and said second connector, said wire rod being positioned along a center axis of said insulating sleeve and said helical coil being wound about an outer circumference of said insulating sleeve.

21. An antenna configuration for a communication device, said antenna configuration comprising:

helical antenna means comprising a helical coil having a first terminal portion separated by an intermediate length from a second terminal portion, said first terminal portion being installed within an antenna housing mounted on a main body of said communication device;

first connecting means electrically coupled to a bottom said first terminal portion of said helical coil for electrically coupling said helical coil to a circuit of said communication device; and a rod antenna comprising an electrically conducting rod surrounded by said helical coil and said first connecting means and being extendable from and retractable into said main body of said communication device, an uppermost length of said rod antenna forming a distal end operating as an exclusive radiating element of said antenna configuration while said rod antenna forms an electrically parallel circuit across said helical coil when said electrically conducting rod is extended from said main body of said communication device by forming a continuous electrical connection between said electrically conducting rod and said first terminal portion and a second electrical connection between said electrically conducting rod and said second terminal portion, and said distal end being physically surrounded by and electrically separated from said helical coil while interrupting said first electrical connection and said second electrical connection to accommodate operation of said helical coil as said exclusive radiating element of said antenna configuration when said electrically conducting rod is retracted into said main body of said communication device and electrically insulated form said helical coil.

22. The antenna configuration as claimed in claim 21, further comprising second connecting means electrically coupled to said second terminal portion of said helical coil, for forming said second electrical connection by electrically coupling said electrically conducting rod to said helical coil when said electrically conducting rod is extended from said main body of said communication device.

23. The antenna configuration as claimed in claim 22, wherein said second connecting means is comprised of a metallic cylindrical tube surrounding said wire rod.

24. The antenna configuration as claimed in claim 23, wherein said rod antenna comprises:

an end portion positioned at a bottommost end of said wire rod for engaging said first connecting means to electrically couple said wire rod to said first terminal portion of said helical coil when said wire rod is extended from said main body of said communication device; and a contact member extending outwardly from said wire rod to engage an interior portion of said metallic cylindrical tube and electrically couple said wire rod to said second terminal portion of said helical coil when said wire rod is extended from said main body of said communication device.

25. The antenna configuration as claimed in claim 22, wherein said rod antenna further comprises:

an end portion positioned at a bottommost end of said electrically conducting rod for engaging said first connecting means to electrically couple said electrically conducting rod to said first terminal portion of said helical coil when said electrically conducting rod is extended from said main body of said communication device; and a contact member extending outwardly from said electrically conducting rod to engage said second connecting means and electrically couple said electrically conducting rod to said second terminal portion of said helical coil when said electrically conducting rod is extended from said main body of said communication device.

26. An antenna configuration for a communication device, said antenna configuration comprising:

helical antenna means comprising a helical coil having a first terminal portion separated by an intermediate length from a second terminal portion, said first terminal portion being installed within an antenna housing mounted on a main body of said communication device;

first connecting means electrically coupled to said first terminal portion of said helical coil for electrically coupling said helical coil to a circuit of said communication device; and rod antenna means comprising an electrically conducting rod surrounded by said helical coil and said first connecting means and being extendable from and retractable into said main body of said communication device, an uppermost length of electrical conducting rod operating as an exclusive radiating element of said antenna configuration while said rod antenna means forms an electrical short circuit between said first terminal portion to said second terminal portion of said helical coil when said electrically conducting rod is extended from said main body of said communication device, and a section of said uppermost length being physically surrounded by and electrically separated from said helical coil while said helical coil operates as said exclusive radiating element of said antenna configuration when said electrically conducting rod is retracted into said main body of said communication device and electrically separated from said helical coil.

* * * * *